US005936490A

United States Patent [19]

Hershtig

[11] Patent Number: 5,936,490

[45] Date of Patent: Aug. 10, 1999

[54] BANDPASS FILTER

[75] Inventor: Rafi Hershtig, Salisbury, Md.

[73] Assignee: K&L Microwave Inc., Salisbury, Md.

[21] Appl. No.: 08/902,359

[22] Filed: Jul. 29, 1997

Related U.S. Application Data

[60] Provisional application No. 60/022,444, Aug. 6, 1996.

[51] Int. Cl.[6] ..... H01P 1/208; H01P 7/10

[52] U.S. Cl. ..... 333/202; 333/219.1

[58] Field of Search ..... 333/202, 208, 333/219.1, 209, 212, 230

[56] References Cited

U.S. PATENT DOCUMENTS

| | | | |
|---|---|---|---|
| 3,969,692 | 7/1976 | Williams et al. | 333/212 |
| 4,167,713 | 9/1979 | Pfitzenmaier | 333/212 |
| 4,216,448 | 8/1980 | Kasuga et al. | 333/203 |
| 4,246,555 | 1/1981 | Williams | 333/230 X |
| 4,423,397 | 12/1983 | Nishikawa et al. | 333/219 |
| 4,453,146 | 6/1984 | Fiedziuszko | 333/212 |
| 4,477,785 | 10/1984 | Atia | 333/202 |
| 4,620,168 | 10/1986 | Delestre et al. | 333/202 |
| 4,630,009 | 12/1986 | Tang | 333/212 X |
| 4,652,843 | 3/1987 | Tang et al. | 333/212 |
| 4,677,402 | 6/1987 | Cesani et al. | 333/203 |
| 4,714,903 | 12/1987 | Brand | 333/110 |
| 4,772,863 | 9/1988 | Rosenberg et al. | 333/212 |
| 4,862,122 | 8/1989 | Blair, Jr. et al. | 333/202 |
| 4,963,841 | 10/1990 | Sparagna | 333/202 |
| 5,051,714 | 9/1991 | Bentivenga et al. | 333/227 |
| 5,083,102 | 1/1992 | Zaki | 333/212 |
| 5,179,074 | 1/1993 | Fiedziuszko et al. | 505/1 |
| 5,200,721 | 4/1993 | Mansour | 333/202 |
| 5,220,300 | 6/1993 | Snyder | 333/210 |
| 5,311,160 | 5/1994 | Higuchi et al. | 333/219.1 |
| 5,315,274 | 5/1994 | Särkkä | 333/219.1 |
| 5,373,270 | 12/1994 | Blair et al. | 333/202 |
| 5,495,216 | 2/1996 | Jachowski | 333/208 |

OTHER PUBLICATIONS

Cameron, "General Prototype Network–Synthesis Methods for Microwave Filters", ESA Journal 1982, vol. 6, pp. 193–206, Mar. 1982.

Ji–Fuh Liang et al., "High–Q TE01 Mode DR Filters PCS Wireless Base Stations," *IEEE Transactions on Microwave Theory and Techniques,* vol. 46, No. 12, Dec. 1998, pp. 2493–2500.

*Primary Examiner*—Seungsook Ham
*Attorney, Agent, or Firm*—Banner & Witcoff, Ltd.

[57] ABSTRACT

A bandpass filter having three waveguide cavities probelessly coupled in a tri-section for producing an asymmetric response about a passband. In another aspect, the bandpass filter also includes first and second waveguide tri-sections coupled in series via a common waveguide cavity, providing a bandpass waveguide filter having transmission zeroes on only one side a filter passband.

12 Claims, 11 Drawing Sheets

BANDPASS FILTER

"This application is a continuation of U.S. application Ser. No. 60/022,444, filed Aug. 6, 1996."

BACKGROUND OF THE INVENTION

This invention relates to waveguide cavity filters for use in radio communications systems and, in particular, to waveguide cavity filters disposed in a triplet configuration for implementing a bandpass filter.

As demonstrated by the high prices paid for licenses to portions of the radio frequency spectrum in the United States, there is a need to maximize the services that can be provided over a limited bandwidth. This need is particularly critical in the field of cellular phone communication systems.

Waveguides may be employed in communication systems to minimize losses for high frequency radio waves. Conventionally, waveguide bandpass filters include one or more resonance cavities and coupling probes disposed between each cavity. The use of probes is disadvantageous because the placement of probes is often unpredictable, unrepeatable, and costly. Accordingly, highly efficient waveguide bandpass filters that minimize or eliminate the use of probes have been difficult to achieve.

SUMMARY OF THE INVENTION

Objects of one or more aspects of the invention include overcoming the above problems and disadvantages to form a highly efficient waveguide filter trisection; locating transmission zeroes on only one side a filter passband; and providing a bandpass filter without the use of probes to capacitive coupling adjacent waveguide cavities. One or more of these above objects may be achieved by various aspects of the present invention.

In one aspect of the invention, high-dielectric materials are used in waveguide cavities in a triplet or tri-section configuration to produce transmission zeros on only one side of the filter passband.

In another aspect of the invention, the bandpass filter includes three waveguide cavities. Each waveguide cavity has a high-dielectric resonator positioned within the cavity. Windows are positioned between each adjacent pair of waveguide cavities to inductively couple the cavities. Signals introduced into the cavities are filtered by the interaction of the cavities within the tri-section. The arrangement of the coupling apertures between each adjacent pair of waveguide cavities contributes to the filtering function and causes the transmission zeros to occur at predetermined frequencies on one side of the filter passband.

In still further aspects of the invention, the filter may include three waveguide cavities connected in a tri-section configuration. Where two apertures and one probe are utilized to couple the trisection, transmission zeros appear only on the high side of the passband. Where three apertures are utilized to couple the tri-section, the transmission zeros appear only on the low side of the passband.

In yet other aspects of the invention, the filter may include two, three, four, five, six, or more tri-sections coupled together. In these configurations, the filter may provide transmission zeros on one or both sides of the passband.

In still other aspects of the invention, the filter may include first, second, third, fourth and fifth waveguide cavities with the first, second, and third waveguide cavities being coupled together in a first tri-section configuration, and the third, fourth, and fifth waveguide cavities being coupled together in a second tri-section configuration. In some aspects of the invention, first, second, third, fourth, and fifth coupling apertures are respectively disposed between the first and second, the second and third, the third and fourth, the fourth and fifth and the third and fifth waveguide cavities.

The invention may also include a method of filtering which uses a first waveguide cavity tri-section to bandpass filter a signal by passing the signal in a passband while producing transmission zeros only on one side of the passband.

These and other objects and features of the invention will be apparent upon consideration of the following detailed description of preferred embodiments thereof, presented in connection with the following drawings in which like reference numerals identify like elements throughout. Although the invention has been defined using the appended claims, these claims are exemplary in that the invention is meant to include the elements and steps described herein in any combination or subcombination. Accordingly, there are any number of alternative combinations for defining the invention, which incorporate one or more elements from the existing claims and/or specification (including the drawings) in various combinations or subcombinations.

DETAILED DESCRIPTION OF PREFERRED EMBODIMENTS

Figure 1:
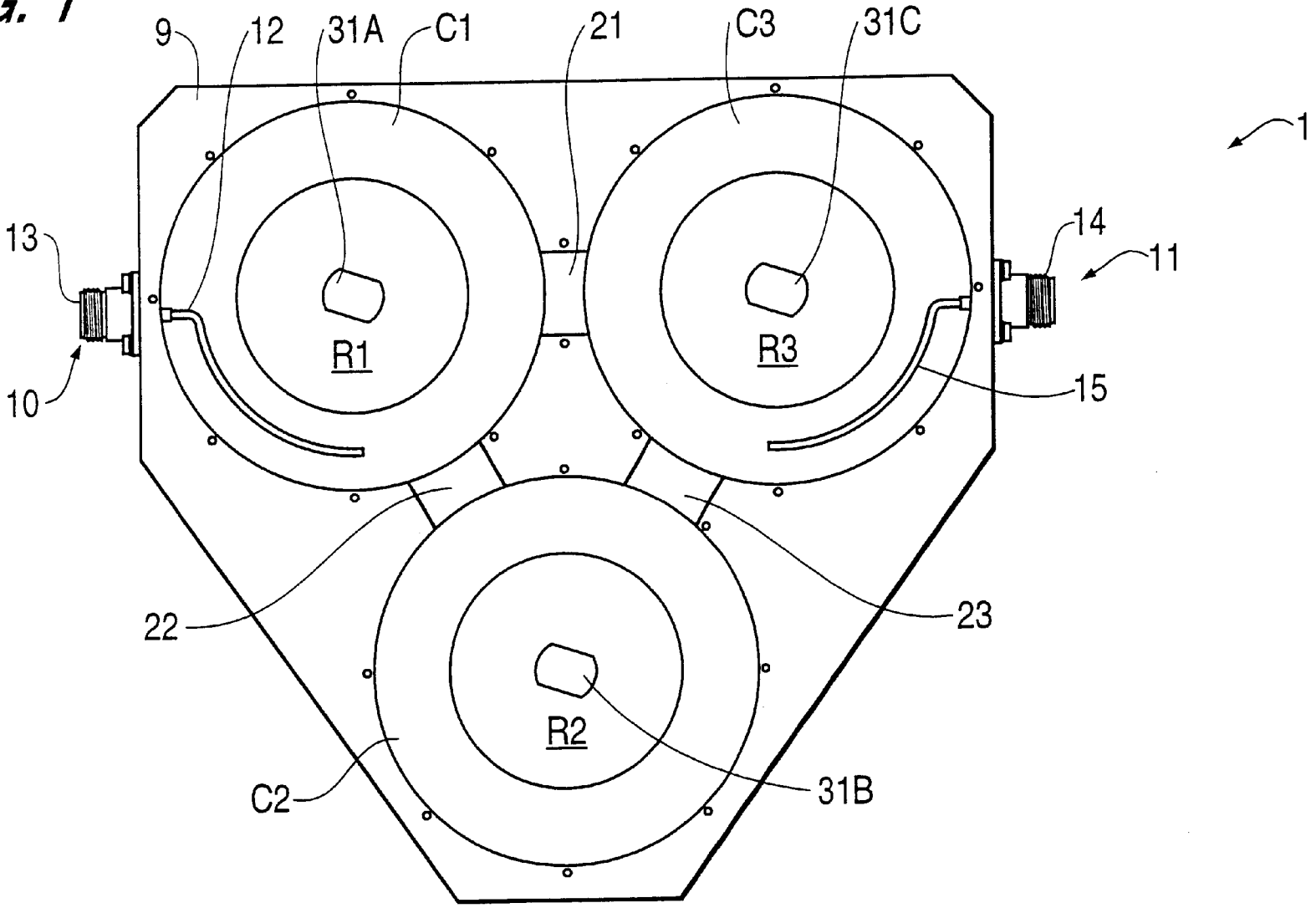
FIG. 1 is a top view of a first embodiment of a waveguide consistent with aspects of the present invention.

Referring to FIG. 1, the first embodiment of the filter 1 may include a housing 9 and a plurality of waveguide cavities C1, C2, and C3 coupled in a tri-section or triplet configuration (i.e., three waveguide cavities with each waveguide cavity directly coupled to every other waveguide cavity). For example, in the embodiment shown in FIG. 1, waveguide cavity C1 is magnetically (inductively) coupled to waveguide cavity C2 via aperture 22; waveguide cavity C2 is magnetically coupled to waveguide cavity C3 via aperture 23; and wave guide cavity C1 is magnetically coupled to waveguide cavity C3 via aperture 21. As discussed below, the tri-section configuration may be variously configured to include different coupling mechanisms.

Further, although the waveguide cavities C1–C3 may be variously formed, in preferred embodiments, the waveguide cavities are cylindrical.

The housing 9 preferably also includes an input 10 coupled to one of the waveguide cavities and an output 11 coupled to another waveguide cavity. In the embodiment shown in FIG. 1, the input 10 is coupled to the first waveguide cavity C1 and the output 11 is coupled to the third waveguide cavity C3. The input 10 and the output 11 may be variously configured to include any inductive, resistive, and/or capacitive coupling arrangement. In the illustrated embodiment, the input 10 includes a connector 13 coupled to an input probe 12 for capacitively coupling the probe to the first waveguide cavity C1. Similarly, the output 11 is coupled to the third waveguide cavity C3 via connector 14 and an output probe 15. The input and output probes may be variously configured. For example, in the illustrated embodiments, the input and output probes are formed of a wire electrically coupled to the connectors and curved along the outside of the associated resonator. This wire is preferably placed where the E-FIELD exists. The curving of the wire is in the M direction. In less preferred embodiments, the open wire may be replaced with a short loop coupling mechanism. Other arrangements for the probes will be apparent to those skilled in the art. In the first embodiment, the resonators R1–R3 are respectively disposed in waveguide cavities C1–C3. In the most preferred embodiments, each resonator is a high Q dielectric puck. The resonators are preferably formed from ceramic. The resonators may be any suitable commercially available resonator such as the those available from Control Device, Standish Maine or from Transpech, Adamstown Md.

Figure 2:
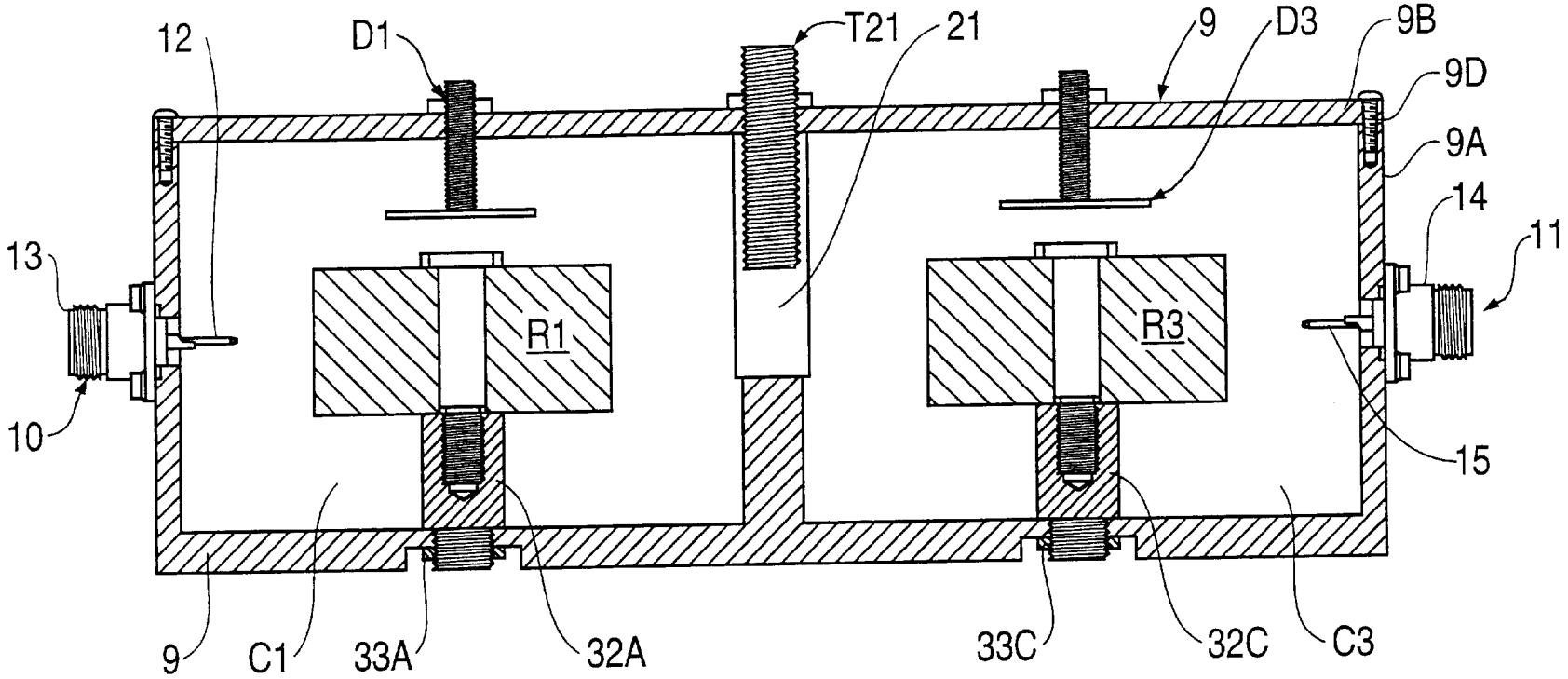
FIG. 2 is a sectioned view of the first embodiment.

Referring to FIG. 2, the housing may comprise one or more pieces such as bottom piece 9A, tuning plate 9B, and one or more bolts 9D. The housing is preferably formed from a conductive material such as a metal.

A plurality of supports 32A, 32B (not shown), and 32C are utilized to support the resonators within the housing. The supports preferably insulate the resonators from the housing. In the illustrated embodiment, the resonators are coupled to the supports 32A–32C via one or more bolts 31A–31C. The supports 32A–32C and/or interlocking bolts 31A–31C may be formed from any suitable low dielectric constant material such a polymeric material or a ceramic material. The supports may in turn be coupled to the housing using nuts 33A, 33B (not shown), and 33C. In the most preferred embodiments, the supports are formed from Lexan.

In preferred embodiments, tuning disks D1, D2 (not shown), and D3 are disposed substantially within the waveguide cavities C1–C3 opposed to the resonators R1–R3, respectively. The tuning disks D1–D3 preferably extend through the tuning plate 9B in a manner such that the gap between each of the tuning disks and an associated resonator may be adjusted from outside the housing 9. For example, each of the tuning disks may be threaded through the tuning plate 9B into the waveguide cavity. In this manner, the tuning of each cavity may be accomplished by simply rotating the turning disks. In the most preferred embodiments, each cavity is tuned to a particular resonant frequency by suitably positioning the tuning disk.

The size of the apertures 21–23 control the amount of magnetic coupling between adjacent waveguide cavities. In some embodiments, it may be preferable to provide a tuning mechanism for fine tuning the amount of magnetic coupling between adjacent waveguide cavities. For example, in the illustrated embodiment as shown in FIG. 2, tuning screws T21, T22 (not shown) and T23 (not shown) are respectively included in apertures 21, 22, and 23. The tuning screws T21, T22, T23 are preferably threaded into tuning plate 9B. The tuning screws allow the amount of interstage coupling to be adjusted by simply rotating the tuning screws.

The loading of the waveguide cavities may be variously controlled. For example, where probes 12 and 15 are utilized, the loading of waveguide cavities C1 and C3 may be controlled by either adjusting the respective probes 12, 15 and/or by adjusting the respective tuning discs D1, D3. In waveguide cavities where a probe is not utilized, loading may be achieved by adjusting one or more associated tuning screws.

Figure 3:
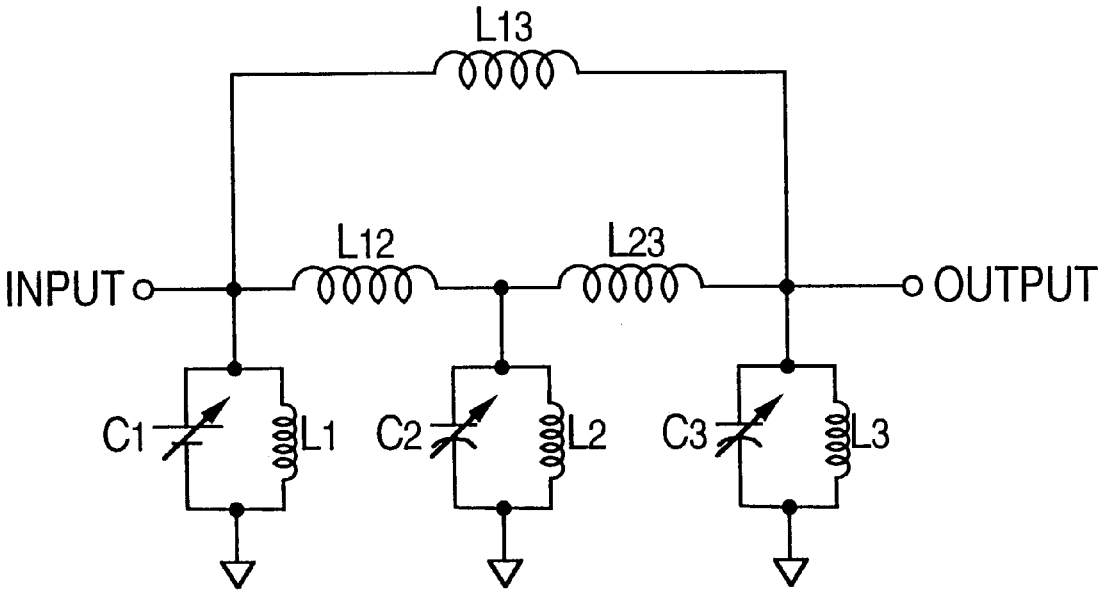
FIG. 3 is an equivalent circuit model of the first embodiment.

FIG. 3 shows a simplified equivalent circuit for the first embodiment of the filter 1. In FIG. 3, the first, second, and third waveguide cavity/resonator combinations C1/R1, C2/R2, C3/R3 form the respective tuned resonance circuits C1–L1, C2–L2, and C3–L3. The magnetic coupling between waveguide cavity C1 and waveguide cavity C2 is represented by inductor L12; the magnetic coupling between waveguide cavity C2 and waveguide cavity C3 is represented by inductor L23; and the magnetic coupling between waveguide cavity C1 and waveguide cavity C3 is represented by inductor L13.

Figure 4:
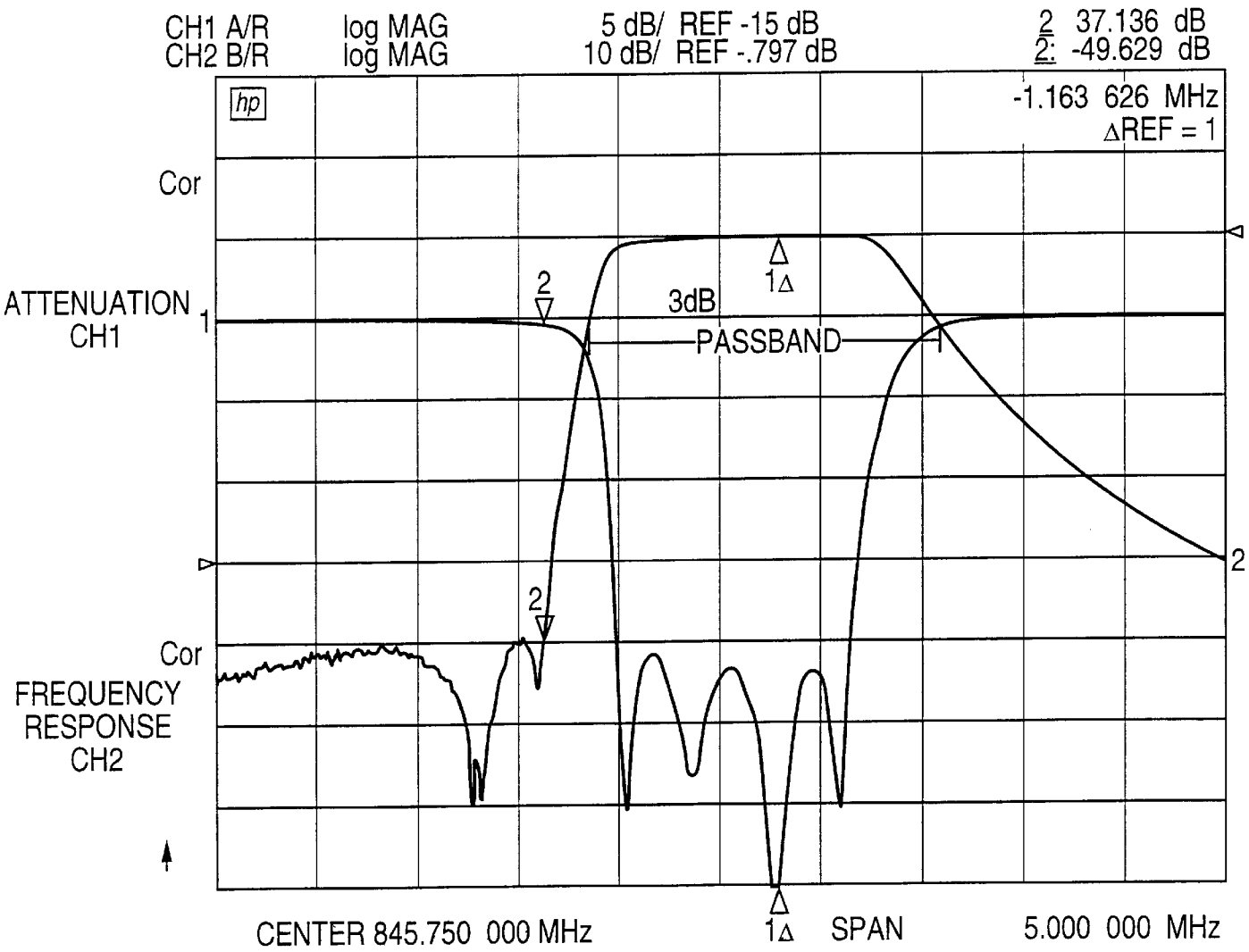
FIG. 4 is a representative graph plotting the frequency response of the first embodiment.

In FIG. 4, the curve "Frequency Response CH2" represents the frequency response of the first embodiment of the filter 1, while the curve "Attenuation CH1" represents the attenuation characteristics of the first embodiment of the filter 1. In FIG. 4, the transmission zeros are on the low frequency side of the passband.

Figure 5:
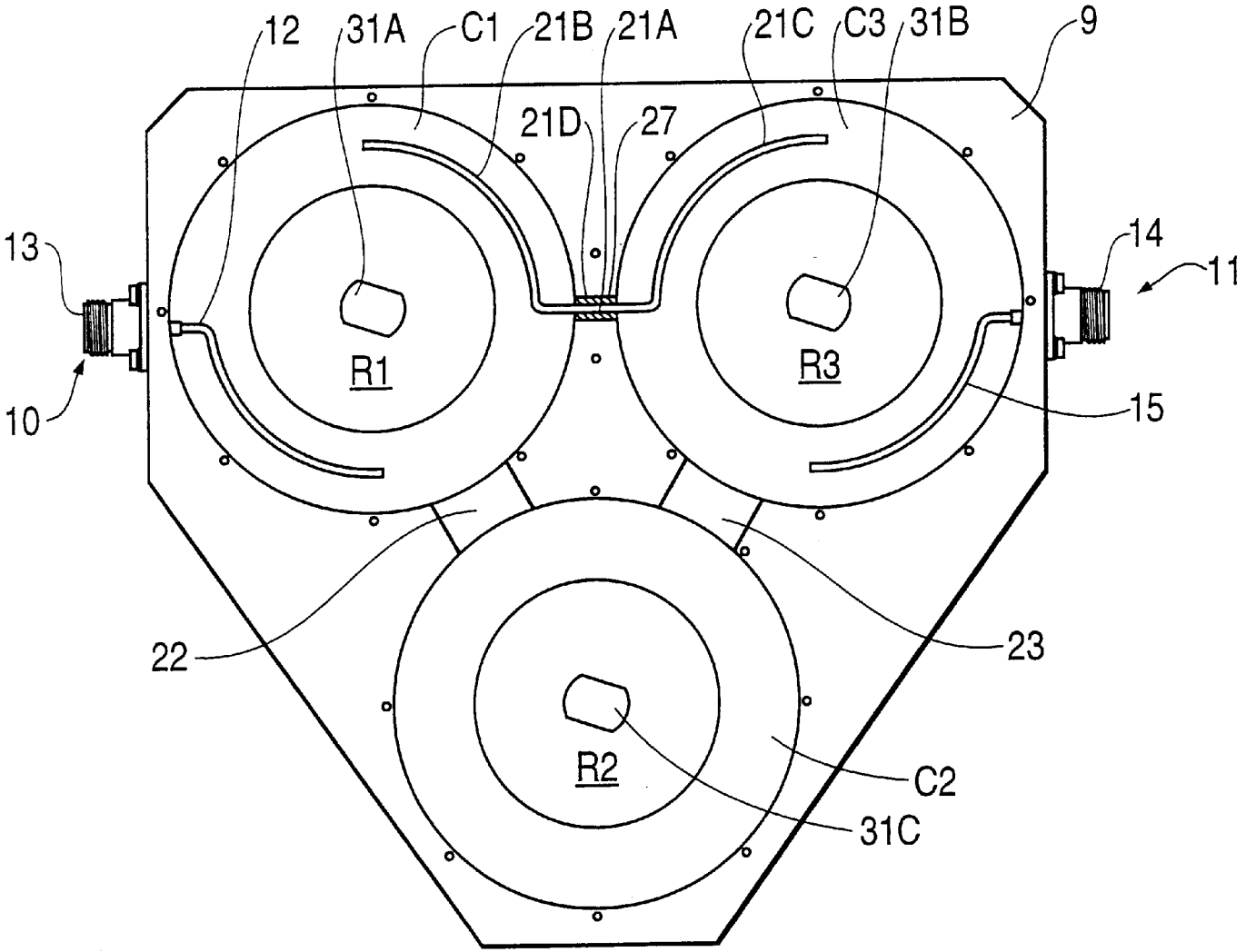
FIG. 5 is a top view of a second embodiment of a waveguide consistent with aspects of the present invention.

FIG. 5 shows a second embodiment of the filter 1 in accordance with aspects of the invention. The second embodiment differs from the first embodiment in that aperture 21 is replaced with probe 21A. Probe 21A includes a first probe portion extending within the first waveguide cavity 21B, a central probe section 21D extending between the first and third waveguide cavities C1, C3, and a second probe section 21C extending within the third waveguide cavity C2. The central section 21D is preferably insulated from the housing 9 using a suitable insulating material 27.

Figure 6:
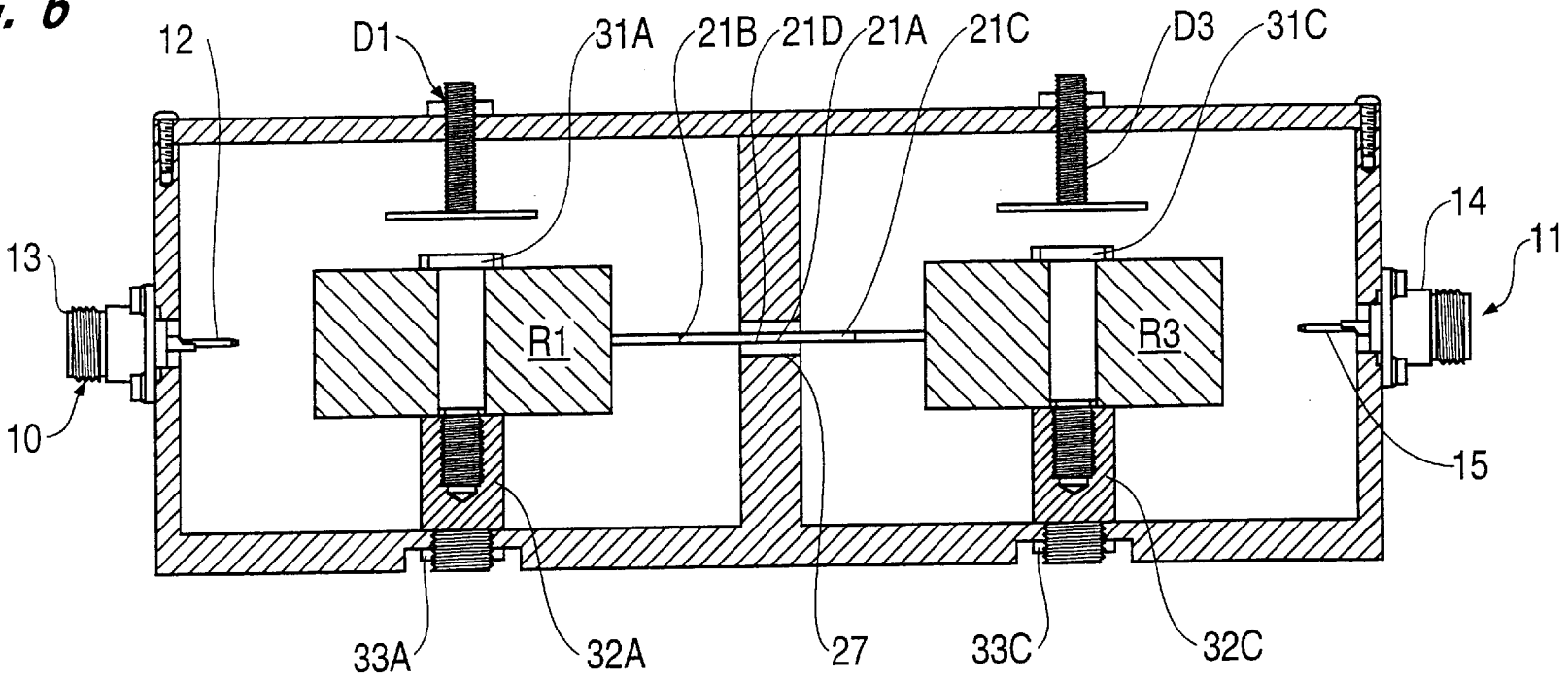
FIG. 6 is a sectioned view of the second embodiment.

FIG. 6 shows a cross section of the second embodiment of the filter 1.

Figure 7:
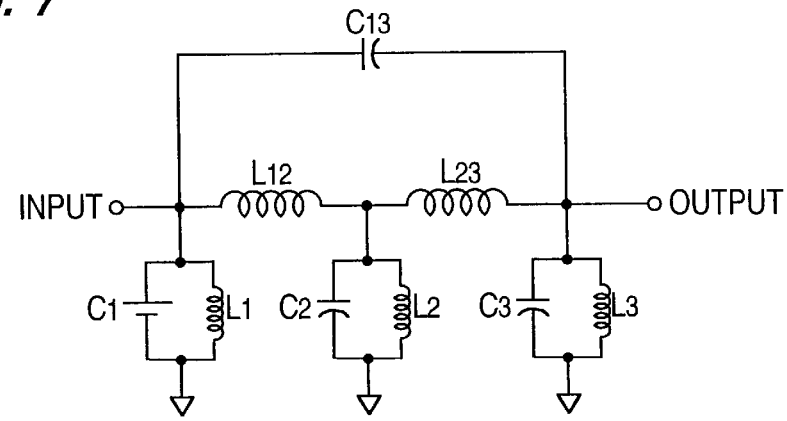
FIG. 7 is an equivalent circuit model of the second embodiment.

FIG. 7 shows the equivalent circuit for the second embodiment of the filter. The equivalent circuit shown in FIG. 7 differs from the equivalent circuit shown in FIG. 3 in that the inductor L13 of FIG. 3 is replaced with a capacitor C13.

Figure 8:
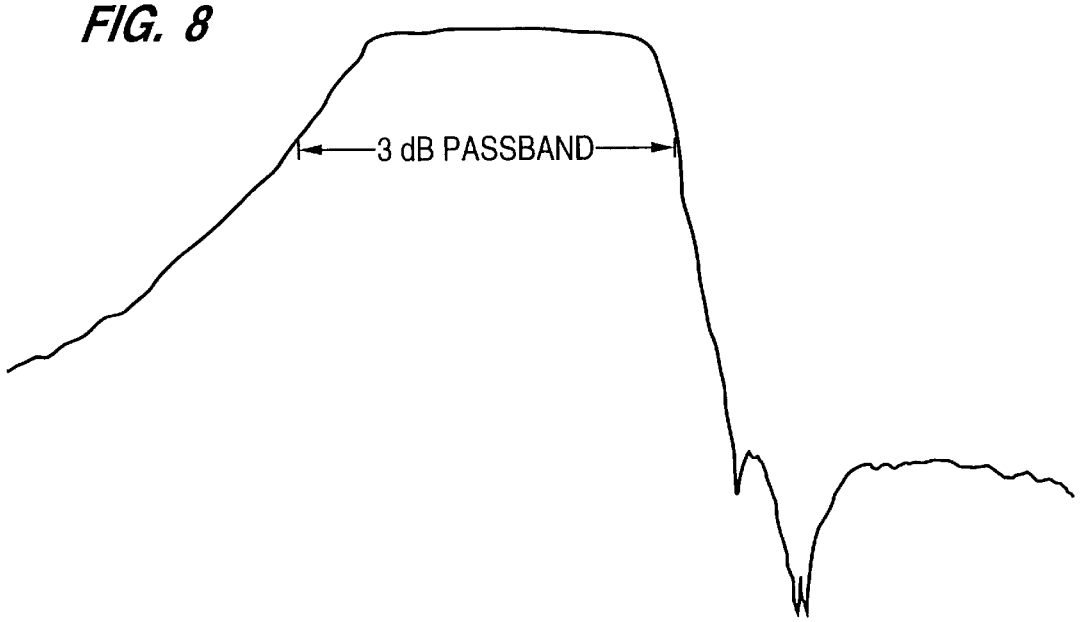
FIG. 8 is representative graph plotting the frequency response of the second embodiment.

FIG. 8 shows the frequency response for the second embodiment of the filter 1 in which the transmission zeros of the filter 1 are on the high frequency side of the passband.

Figure 9:
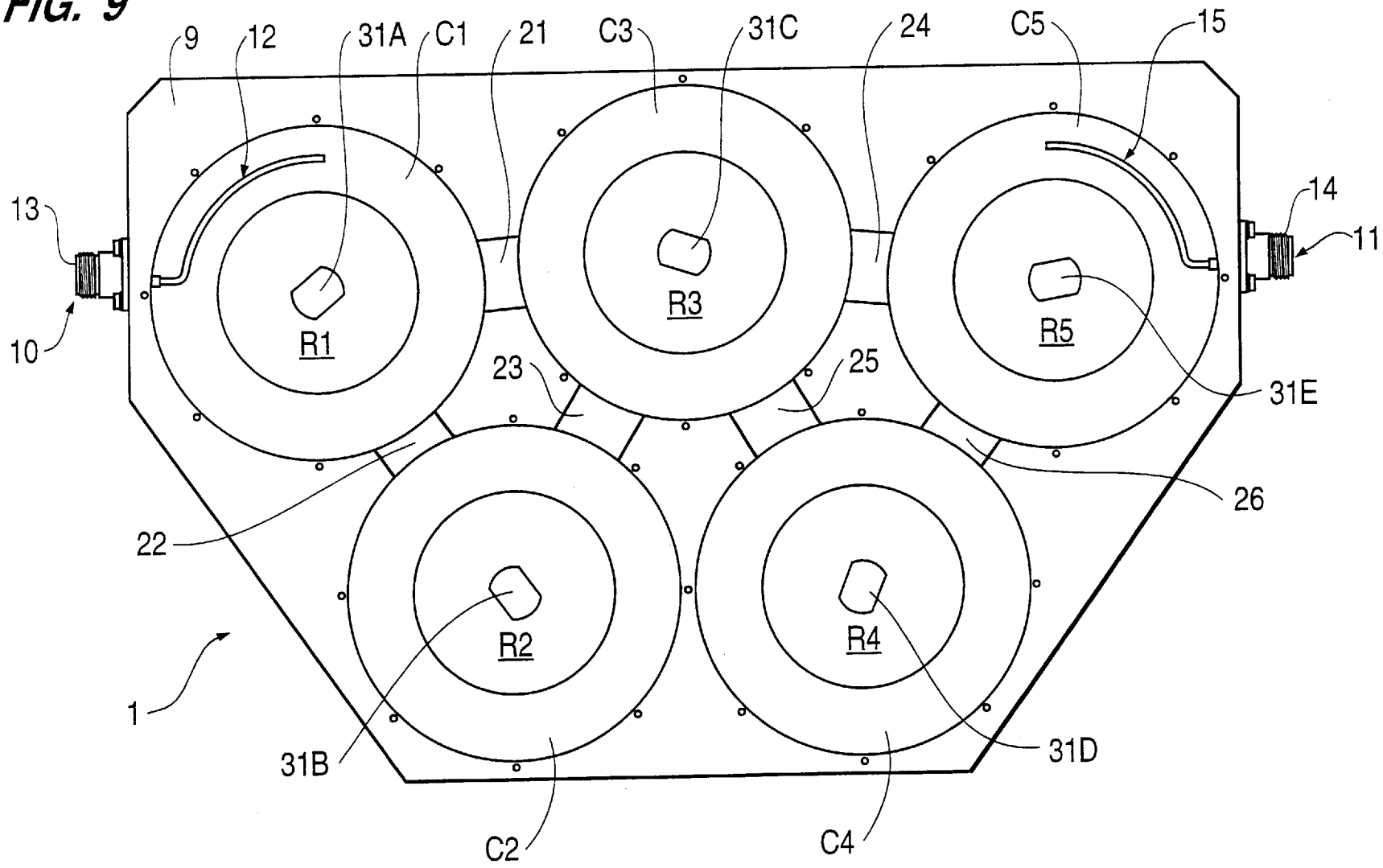
FIG. 9 is a top view of a third embodiment of a waveguide consistent with aspects of the present invention.

FIG. 9 shows a third embodiment of the filter 1. In FIG. 9, two triplet waveguide cavity configurations similar to those of FIG. 1 are coupled together via waveguide cavity C3. In the third embodiment, the last waveguide cavity C3 of the first waveguide tri-section also serves as the first waveguide cavity of the second waveguide tri-section.

The remaining portion of the second tri-section that has not been previously described includes resonators R4 and R5 respectively disposed in waveguide cavities C4, C5. The third waveguide cavity C3 may be coupled to the fourth wave cavity C4 via one or more apertures 25, and to the fifth waveguide cavity C5 via one or more apertures 24. Similarly, the fourth waveguide cavity C4 may be coupled to the fifth waveguide cavity C5 using one or more apertures 26. Each of the waveguide cavities and associate resonators may be constructed in similar manner as discussed above for other embodiments. For example, the resonator R4 is preferably insulated from the housing 9 via bolt 31D, standoff 32D (not shown) and nut 33C (not shown). Similarly, the resonator R5 may be insulated from the housing 9 via bolt 31E, standoff 32E (not shown) and nut 33E (not shown). Similarly, waveguide cavity C4 preferably includes tuning disc D4 (not shown) and wave guide cavity C5 preferably includes tuning disc D5 (not shown). In the most preferred embodiments, all the tuning discs D1–D5 are coupled to the same tuning plate 9B.

Figure 10:
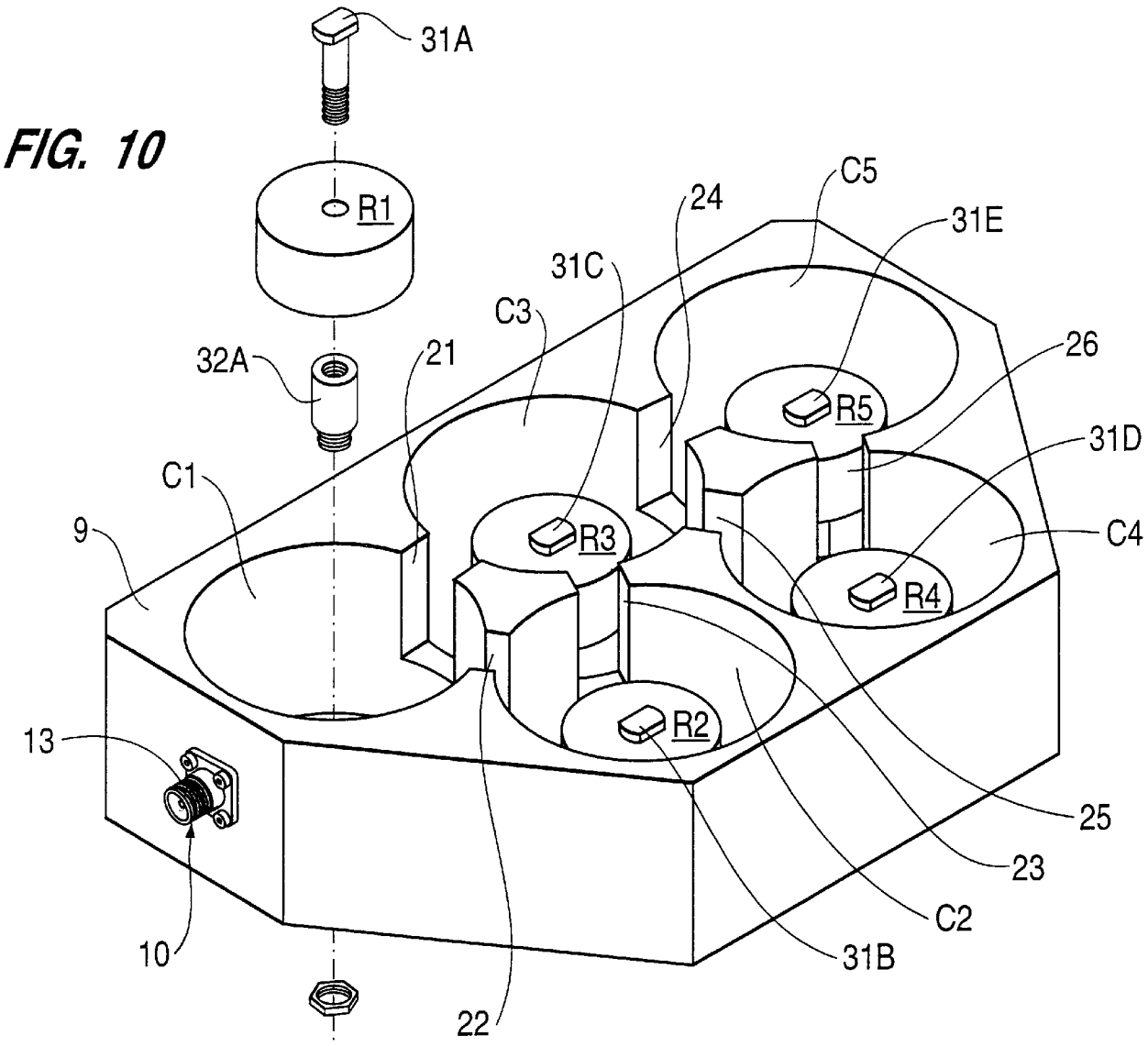
FIG. 10 is a prospective view of the third embodiment.

FIG. 10 shows a perspective view of the third embodiment of the filter 1. In FIG. 10, an exploded view of the resonator R1 is shown for clarity.

Figure 11:
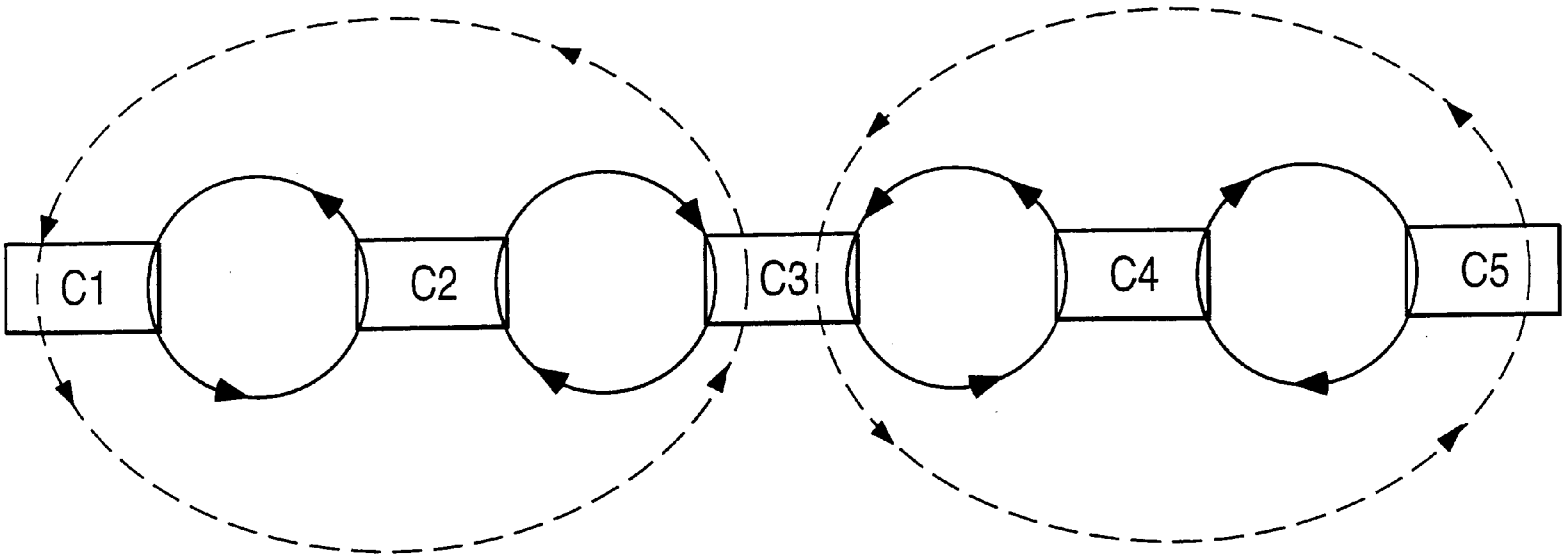
FIG. 11 is a graphical representation of the magnetic flux lines believed to exist in the third embodiment.

FIG. 11 shows the flux lines that are believed to exist for the third embodiment. An extraordinary and totally unexpected result occurs in that there is positive coupling between the two triplet configurations at the third and shared waveguide cavity C3.

Figure 12:
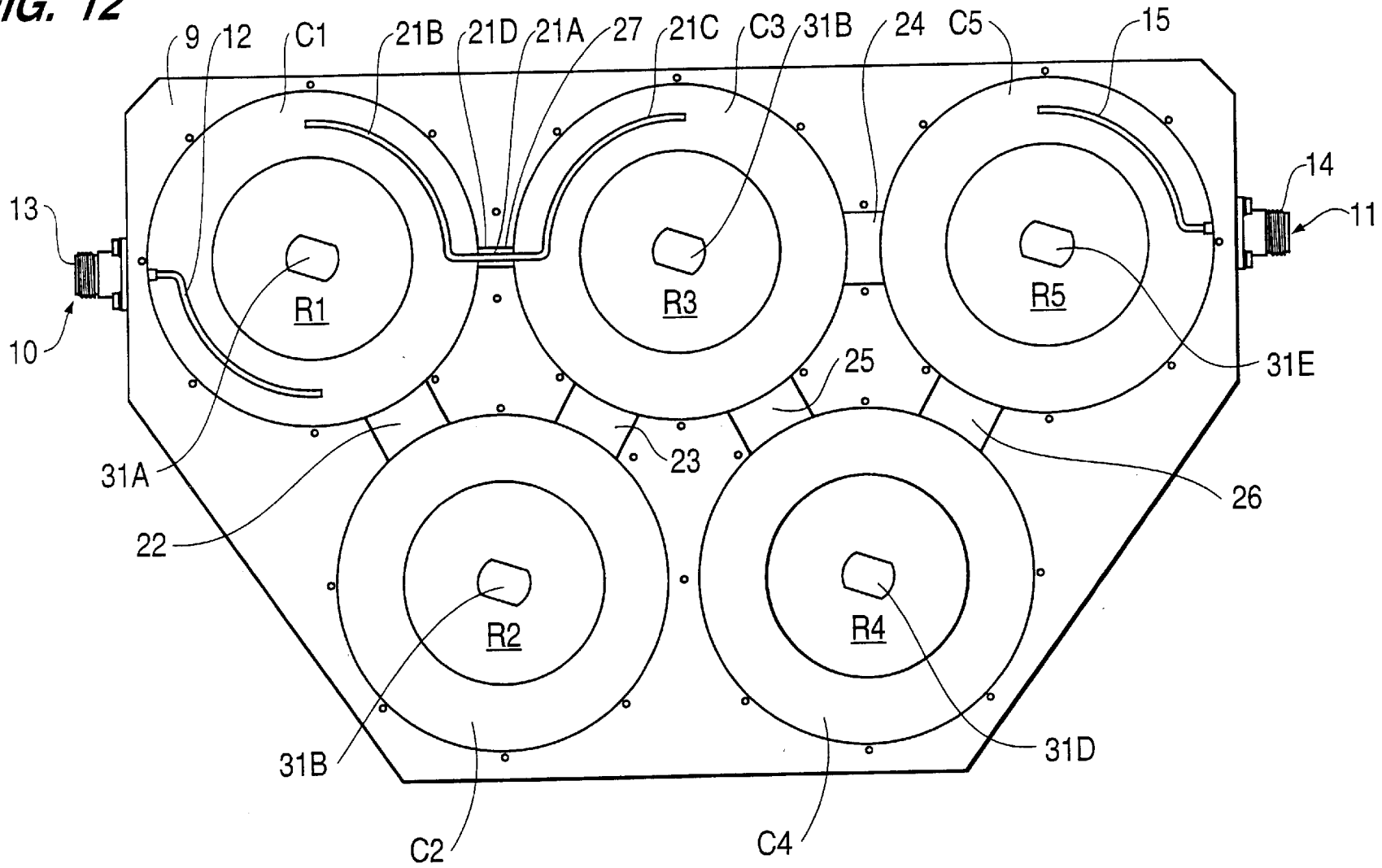
FIG. 12 is a top view of a fourth embodiment of a waveguide consistent with aspects of the present invention.

FIG. 12 shows a fourth embodiment of the filter 1. In FIG. 12, a first waveguide cavity tri-section similar to the embodiment shown in FIG. 5 may be coupled with a second waveguide cavity tri-section similar to the embodiment shown in FIG. 1. In a similar fashion as discussed above, the first and second tri-sections are coupled together by and share waveguide cavity C3. In other words, the last waveguide cavity C3 of the first tri-section also serves as the first waveguide cavity of the second waveguide cavity tri-section.

Referring to FIG. 12, the fourth embodiment of the filter 1 combines the advantages of both the first and second embodiments. In the fourth embodiment, the first waveguide cavity tri-section provides a bandpass filter with the transmission zeros on the high frequency side of the passband while the second waveguide cavity tri-section provides a bandpass filter with the transmission zeros on the low frequency side of the passband. By coupling the two filters in series, the sharp cut off frequency response of both the high-side and low-side transmission zeros are achieved, providing a significant improvement over conventional symmetric bandpass filters.

In operation, an input signal (e.g., radio frequency signals) may be input into the filter 1 at input 10. The input 10 couples the input signal to the first of a plurality of loaded waveguide cavities and excites the cavity to resonate in the dominant TE01 mode. The resultant energy is coupled to two immediately adjacent cavities. The coupling may be either inductive through apertures or capacitive through probes. However, in the most preferred embodiments the use of probes is minimized. For example, in the embodiments of FIGS. 1 and 9, the bandpass filter is realized without the use of probes to couple adjacent waveguide cavities within the tri-section, i.e., the filter is a probelessly waveguide cavity bandpass filter. These probelessly bandpass filters have significant advantage over conventional waveguide cavity bandpass filters which utilized probes. Additionally, the probless bandpass filters shown in FIGS. 1 and 9 are particularly advantageous because the filters produce an asymmetric response with the transmission zeros only on one side of the passband. In the configurations shown in FIGS. 1 and 9, the transmission zeros occur only on the low frequency side of the passband. Waveguide filters having an asymmetric response are particularly adapted to significantly improving the performance of cellular telephone communication systems.

Coupling through the apertures provides magnetic (inductive) coupling between adjacent waveguide cavities. Filters having inductive coupling are substantially easier to manufacturer and control to precise tolerances. In the second embodiment, only a single probe is used to form a bandpass filter having transmission zeros on only the high frequency side of the passband. In the second embodiment the use of probes is minimized such that one probe is utilized between only two waveguide cavities.

Using embodiments of the present triplet configurations, the resonant traps, or transmission zeros for a particular triplet configuration occur on either the low side or the high side of the passband, but not on both sides. Accordingly, the out-of-band attenuation of the bandpass filter on the side with the transmission zeros is substantially enhanced providing significant improvements over conventional symmetric bandpass filters.

With inductive coupling, a phase propagation pattern through the multiple paths of the tri-section configuration results in a phase reversal within the third cavity. This phase reversal creates a resonant trap for a predetermined frequency, as depicted in, for example, FIG. 4. As a result, RF energy at the predetermined frequency is prevented from coupling to a fourth cavity and/or output. Accordingly, the trapped frequencies do not propagate further within the filter and/or appear at the output connector.

In particular, the energy of the signal propagating through the input connector excites the dominant mode of the cavity. In the illustrated embodiments, this is the TE01 mode. The signal, in resonance condition, is coupled to waveguide cavities 2 and 3. This forms a basic configuration of the tri-section or triplet configuration and allows for a tri-resonating condition to exist. Due to the pattern of the phase propagation through both paths C1–C2–C3 and through path C1–C3, a phase reversal condition occurs at the third resonator cavity C3. As discussed above, this phase reversal between the main path 1–2–3 and the cross-coupled path 1–3 causes a trap (resonance condition) for the incoming signal. Accordingly, the components of the incoming signal at a predetermined frequency are filtered from the incoming signal.

The above described embodiments of the filter 1 utilize combline waveguide cavities in tri-section configurations and high-dielectric materials disposed in the waveguide cavities to substantially reduce the physical size and improve the performance of waveguide bandpass filters. In particular, the combination of high-dielectric materials in the tri-section configurations have been found to provide totally unexpected results and extremely useful performance characteristics as illustrated by FIGS. 4 and 8 above. Further, the ability to produce zeros of transmission of the low-side of the filter passband using only inductive coupling apertures has significant advantages heretofore unrealized. Embodiments of the present invention are particularly adapted for providing extremely sharp cut-off frequencies and an asymmetric response about the passband. These filters are particularly useful in full-duplex cellular telephone communications where transmit and receive channels share two adjacent frequency channels. In this environment, an embodiment having high-side zeros of transmission may be utilized to separate one channel (either the transmit or receive) and an embodiment having the low side zeros of transmission may be utilized to separate the other channel. In this configuration, the zeros of transmission occur where the adjacent channel is located.

In the most preferred embodiments, the filter 1 is configured to operate in only a single mode: TE01. The single mode operation is preferred because of the extremely sharp cut-off frequencies and asymmetric response provided by the filter. However, in less preferred embodiments, excitation screws may be included in the waveguide cavities in a conventional manner to induce dual mode operation.

While exemplary bandpass filters embodying the present invention are shown by way of example, it will be understood, of course, that the invention is not limited to these embodiments. Modifications may be made by those skilled in the art, particularly in light of the foregoing teachings. For example, the embodiments of FIGS. 1 and 5 form basic building blocks which may be combined in any suitable serial and/or parallel arrangement to form more complex filters. Accordingly, one, two, three, four, five, six, seven, eight, nine, or more triplet waveguide filters may be combined with the high-side asymmetric filter(s) (FIG. 5) and/or the low-side asymmetric filter(s) (FIG. 1) appearing in any predetermined number and in any predetermined order in a serial and/or parallel arrangement. For example, any number of waveguide cavity triplet configurations may be coupled together in series. FIG. 9 shows two low-side waveguide cavity filters coupled in series. FIG. 12 shows a low-side waveguide triplet configuration and a high-side waveguide triplet configuration coupled in series providing a bandpass filter with transmission zeros on both the low and high sides of the passband. Additional embodiments may have any number of series connections of triplet waveguide cavities disposed in series and/or parallel. It is, therefore, intended that the appended claims cover any such modifications which incorporate the features of this invention or encompass the true spirit and scope of the invention. For example, each of the elements of the aforementioned embodiment may be utilized alone or in combination with other elements of the embodiment.

What is claimed is:

1. A filter comprising:

first, second, and third waveguide cavities coupled together in a tri-section configuration;

an input coupled to the first waveguide cavity; an output coupled to the third waveguide cavity;

first, second, and third inductive coupling apertures respectively disposed between the first and second, the second and third, and the first and third waveguide cavities; and first, second, and third high-dielectric resonators respectively disposed in the first, second, and third waveguide cavities wherein signals input into the input are bandpass filtered with transmission zeros appearing only on a low-frequency side of a passband.

2. The filter of claim 1 wherein the high-dielectric resonators are positioned within the waveguide cavities cavities for configuring the waveguide cavities to be tuned over a broad range of frequencies.

3. The filter of claim 1 wherein the high-dielectric resonators comprise a dielectric ceramic material.

4. The filter of claim 1 including first, second, and third standoffs respectively supporting the first, second, and third dielectric resonators.

5. The filter of claim 4 wherein the first, second, and third standoffs include a low dielectric material.

6. The filter of claim 5 wherein the first, second, and third standoffs include a polymeric material.

7. The filter of claim 1 wherein the inductive coupling apertures are probe less.

8. A method of filtering comprising using a first waveguide cavity tri-section to bandpass filter a signal by passing the signal in a passband while producing transmission zeros only on one side of the passband, the first waveguide cavity tri-section including three waveguide cavities probelessly coupled in the tri-section and three resonators respectively disposed in the three waveguide cavities.

9. The method of claim 8 including propagating the signal through the waveguide cavities in only a single mode.

10. The method of claim 8 wherein passing the signal in the passband includes producing transmission zeros only on a low frequency side of the passband.

11. A method comprising asymmetrically bandpass filtering a signal using three waveguide cavities probelessly coupled in a tri-section, the three waveguide cavities including three resonators respectively disposed in the three waveguide cavities.

12. A bandpass filter comprising three waveguide cavities probelessly coupled in a tri-section, and three resonators respectively disposed in the three waveguide cavities.

* * * * *